US005361812A

United States Patent [19]

Arneson et al.

[11] Patent Number: 5,361,812

[45] Date of Patent: Nov. 8, 1994

[54] DISPENSING APPARATUS

[75] Inventors: Theodore R. Arneson, Hawthorne Woods; William A. Miller, Buffalo Grove, both of Ill.

[73] Assignee: Fluid Management Limited Partnership, Wheeling, Ill.

[21] Appl. No.: 36,413

[22] Filed: Mar. 24, 1993

[51] Int. Cl.[5] ..... B65B 3/04; B65B 1/04

[52] U.S. Cl. ..... 141/275; 141/253; 141/254; 141/172

[58] Field of Search ..... 141/275-278, 141/253, 254, 148-150, 172

[56] References Cited

U.S. PATENT DOCUMENTS

| | | | |
|---|---|---|---|
| 969,017 | 8/1910 | Willmann | 141/275 X |
| 1,565,347 | 12/1925 | Willard | 141/275 X |
| 2,073,432 | 3/1937 | Von Segebaden | 141/275 X |
| 2,150,479 | 3/1939 | Anderson | 141/276 X |
| 2,772,705 | 12/1956 | Anderson | 141/277 X |
| 2,839,093 | 6/1958 | McCarthy | 141/275 X |
| 4,305,437 | 12/1981 | Greene | 141/275 X |
| 5,116,134 | 5/1992 | Edwards et al. | 366/208 |

OTHER PUBLICATIONS

"The Colour Philosophy," 16 page Trade Brochure of (manufacturer) COROB (no date available).

"Miller Accutinter® 4000 Colorant Dispenser," 1 page, 2-sided Brochure RA9114/ACC4000, Printed in USA, Miller Manufacturing® A Division of Fluid Management Limited Partnership, Addison, Ill. (No date shown on brochure).

"Miller Accutinter® 400 Colorant Dispenser," 1 page, 2-sided Brochure RA9019/ACC400, Printed in USA, Miller Manufacturing® A Division of Fluid Management Limited Partnership, Addison, Ill. (No date shown on brochure).

"Miller Accutinter® 600 Fluid Dispenser," 1 page, 2-sided Brochure RA90108/ACC600, Printed in USA, Miller Manufacturing® A Division of Fluid Management Limited Partnership, Addison, Ill. (No date shown on brochure).

"The Eurotinter: A Powerful and Well Researched Concept.," 1 page brochure, Ateliers Sussmeyer S.A., Bruxelles (No date shown on brochure).

"Eurotinter E-12-AS and E-16-AS-An Avalance of Possibilities.," 1 page brochure, Ateliers Sussmeyer S.A., Bruxelles (No date shown on brochure).

"E. T. Junior: Low Investment for Tinting Paints and Varnishes for Retail Distribution.," 1 page brochure, Ateliers Sussmeyer S.A., Bruxelles (No date shown on brochure).

"From Retail Shop to In-Plant Production Unit-The Eurotinter.," 1 page brochure, Ateliers Sussmeyer S.A., Bruxelles (No date shown on brochure).

*Primary Examiner*—Ernest G. Cusick

*Attorney, Agent, or Firm*—Fitch, Even, Tabin & Flannery

[57] ABSTRACT

An automated dispenser for liquid and pulverulent materials dispenses the materials into a container located below a dispense head. The container is supported by a shelf extending in front of the dispenser. The shelf is divided into sections, with the section located below the dispense head being mounted for raising and lowering toward and away from the dispense head. A scissors lift mechanism supports the center shelf portion, and a locking arrangement at the bottom of the scissors lift mechanism locks the lift mechanism at a desired height. A foot pedal releases the locking arrangement, permitting the shelf portion to be moved to a different height.

6 Claims, 12 Drawing Sheets

DISPENSING APPARATUS

BACKGROUND OF THE INVENTION

1. Field of the Invention

The present invention pertains to dispensing apparatus, and in particular to dispensing apparatus having manually operated conveyor systems associated with a dispensing operation.

2. Description of the Related Art

Automated dispensing apparatus has been proposed for liquid and pulverulent materials. Examples of such automated dispensing apparatus are given in U.S. Pat. De. Nos. 262,628 and 262,629, commonly assigned to the assignee of the present invention. In use, an operator slides a container of paint base material along a shelf, underneath a dispense head in preparation for a dispensing operation. The shelf is mounted to a front face of the dispenser cabinet, and is located generally at waist height.

While this arrangement is suitable for smaller size containers (e.g., 1-gallon size containers), it is difficult for an operator to lift a large number of larger size containers (e.g., 5-gallon size containers) throughout the course of a workday. Accordingly, other solutions have been sought for relatively high volume production runs in which many containers are processed in a relatively short period of time. For example, commonly assigned U.S. Pat. No. 5,116,134 includes a roller conveyor system for transporting containers, such as cans containing paint base and tint materials, to a mixing station. A section of the roller conveyor is mounted for translational movement in directions generally normal to the path of travel of containers along the conveyor. The conveyor section is movable into and out of a specially designed container mixing unit, which affords a complete automatic operation not requiring operator intervention.

Other examples of automated conveyor operation for paint containers and the like are given in commonly assigned U.S. Pat. Nos. 5,083,591 and 5,137,367. These patents describe conveyor systems in which containers traveling along the conveyor system may be redirected to various locations as desired.

A need still exists for improved handling of relatively heavy containers filled with material which is to be processed using automated or mechanized equipment.

SUMMARY OF THE INVENTION

It is an object according to principles of the present invention to provide a conveyor system for lifting containers into position on an apparatus for processing contents of the container.

Another object according to principles of the present invention is to provide paint dispensing apparatus having improved conveyor handling equipment.

Yet another object according to principles of the present invention is to provide paint dispensing apparatus with improved raising and lowering of containers for a dispensing operation.

It is a further object according to principles of the present invention to provide container-handling apparatus which is manually operated, and which is readily adaptable for use with existing equipment, requiring a minimum number of inexpensive parts for its practical realization.

These and other objects according to principles of the present invention are provided in apparatus for dispensing material into a container, comprising:

a supporting frame;

a housing supported by said frame;

dispense means supported by said housing for controlling a flow of material therethrough in response to control commands;

container support means supported by said frame for supporting the container below said dispense means, said container support means including a pair of end portions with an intermediate portion therebetween; and mounting means for mounting the intermediate portion toward and away from said dispense means, said mounting means including a plurality of linkages pivotally connected to form a scissors support which is extendible toward the dispense means and collapsible away from the dispense means so as to cooperate with said end portions to form a generally continuous support surface across which a container can be moved.

DETAILED DESCRIPTION OF THE PREFERRED EMBODIMENT

Figure 1:
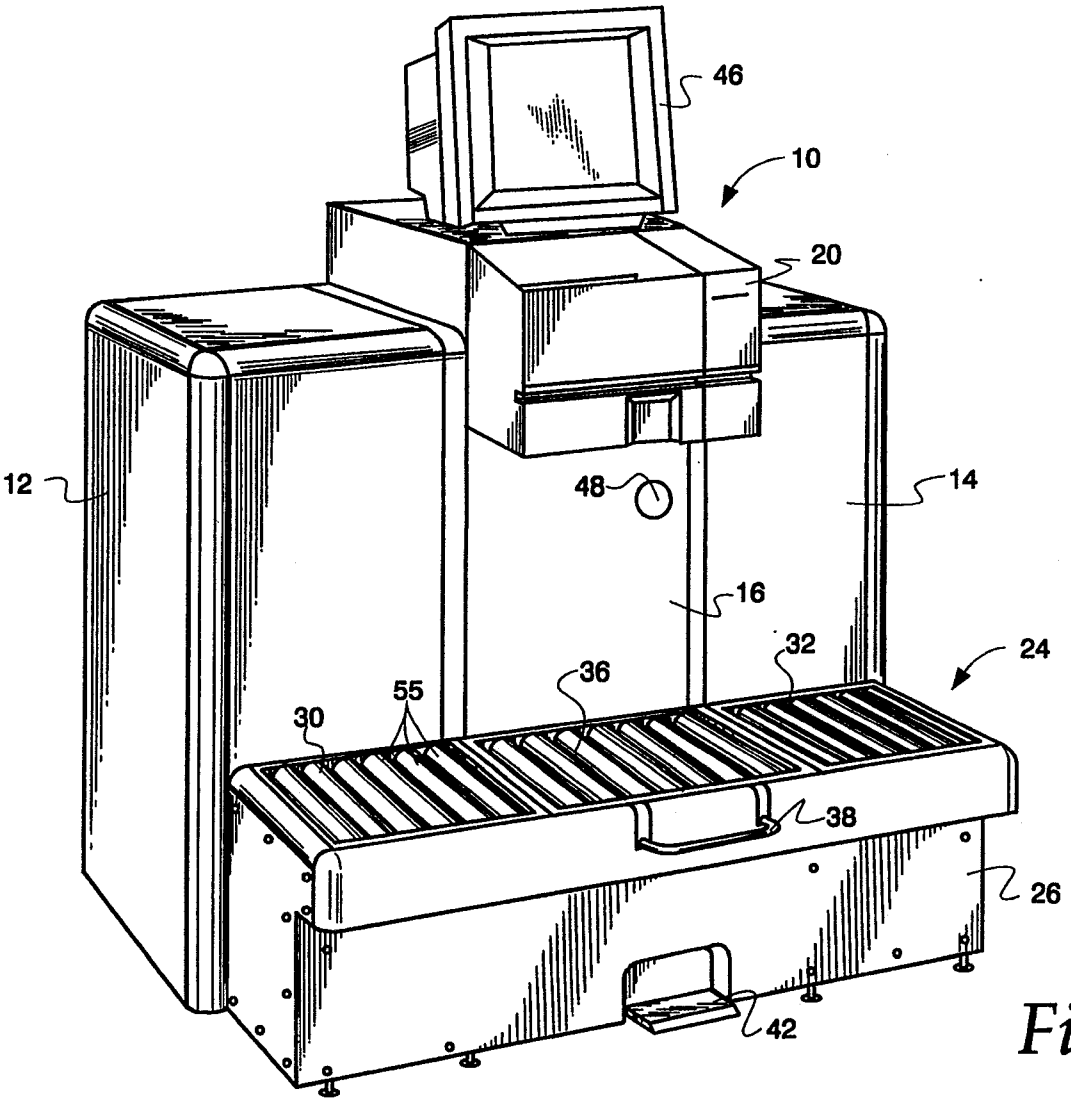
FIG. 1 is a perspective view of dispensing apparatus according to principles of the present invention.
Figure 3:
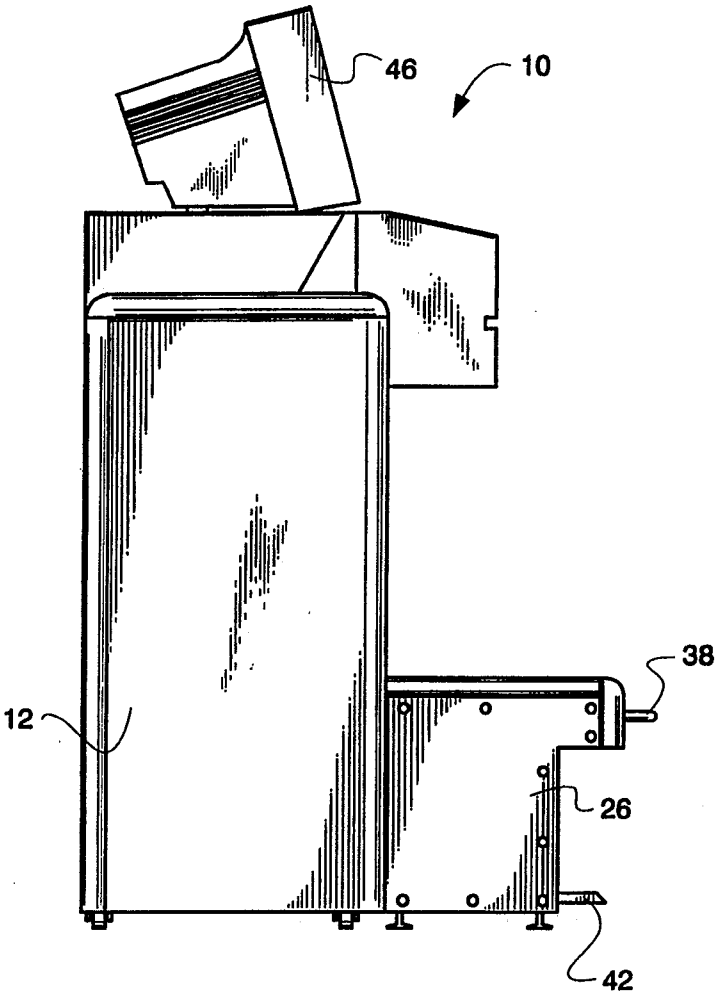
FIG. 3 is an elevational view from the left side thereof.
Figure 2:
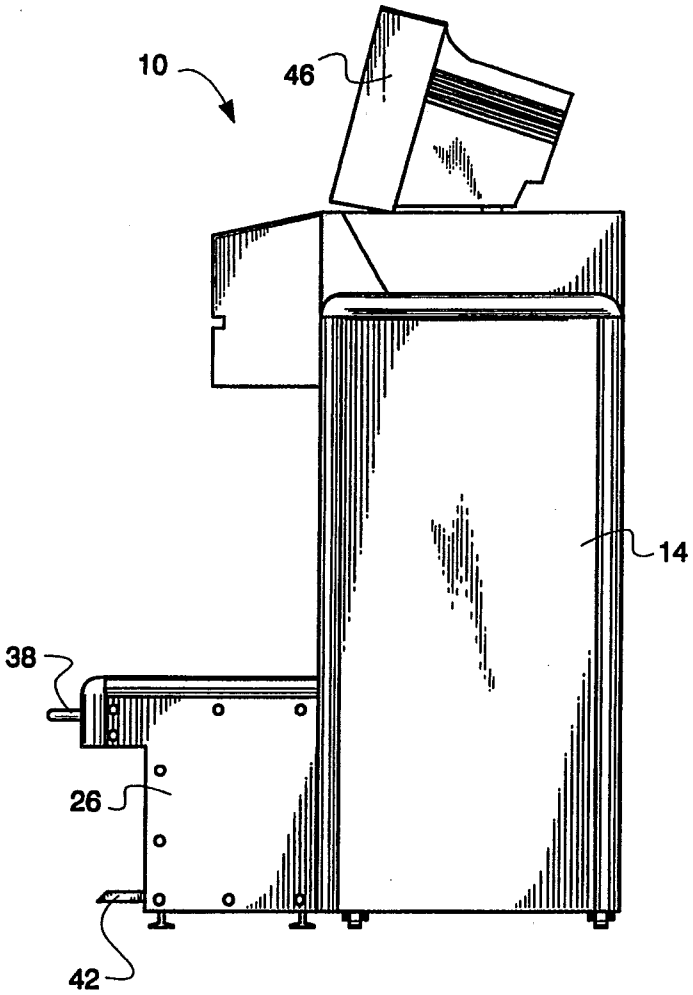
FIG. 2 is an elevational view from the right side thereof.
Figure 5:
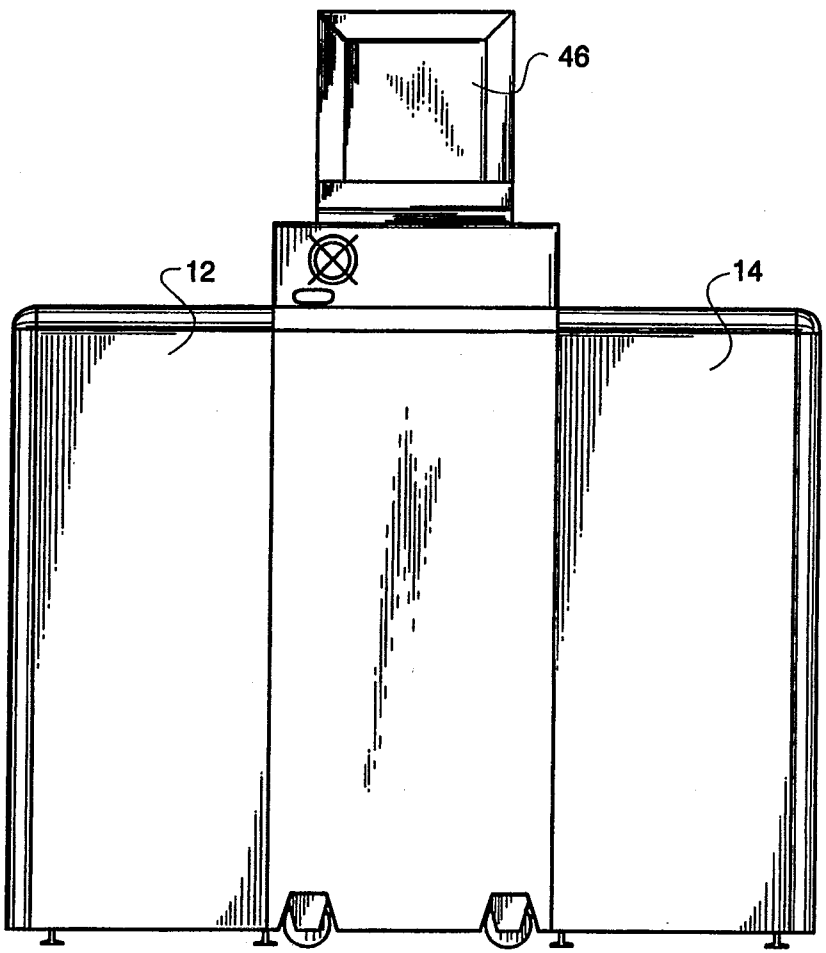
FIG. 5 is a rear elevational view thereof.
Figure 4:
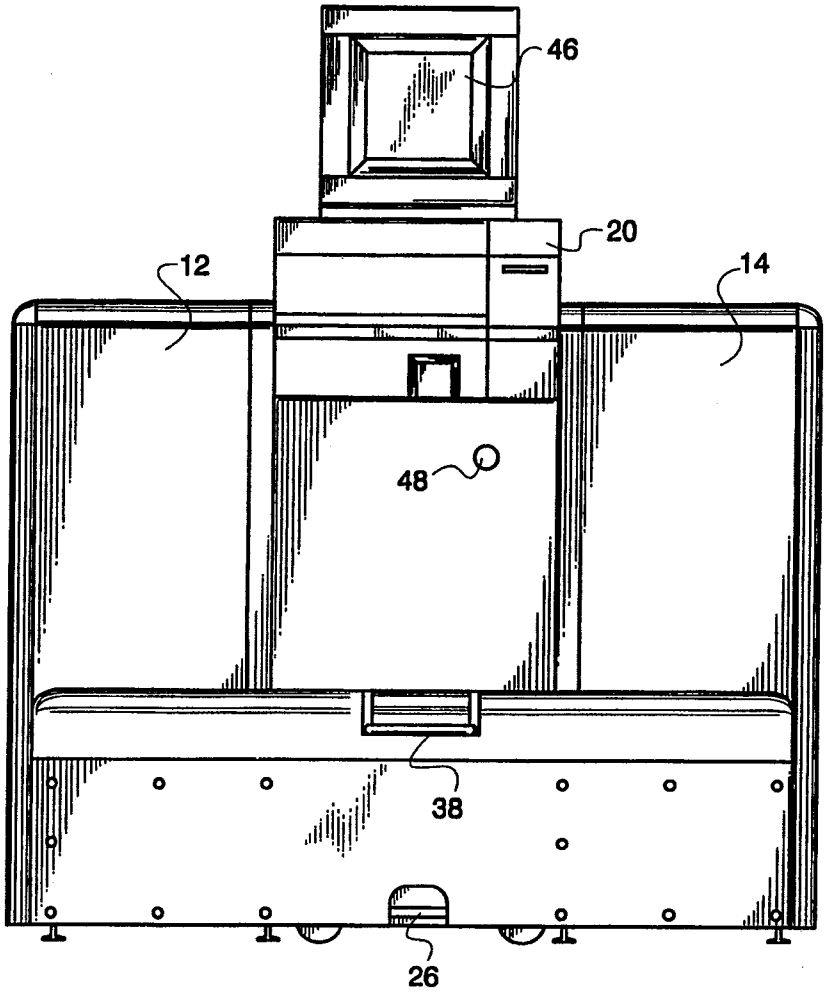
FIG. 4 is a front elevational view thereof.
Figure 7:
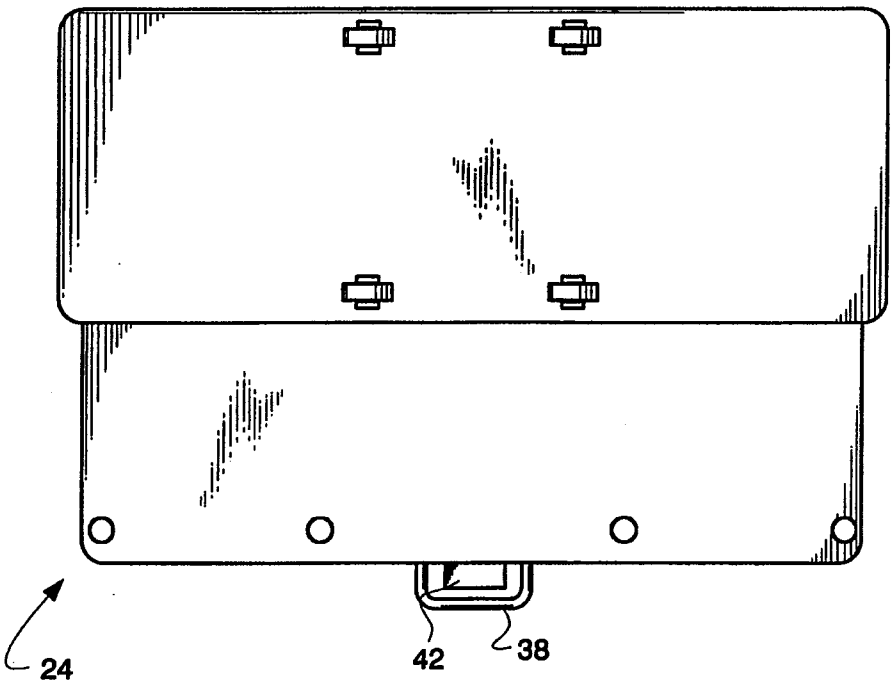
FIG. 7 is bottom plan view thereof.
Figure 6:
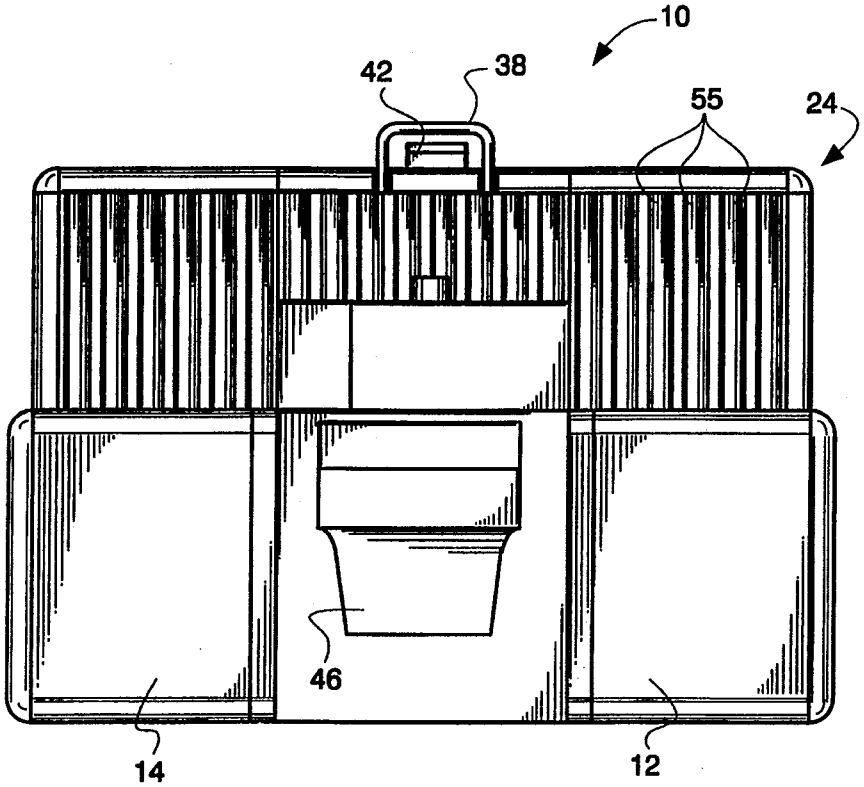
FIG. 6 is a top plan view thereof.

Referring now to the drawings, FIG. 1 shows a dispensing apparatus generally indicated at 10. The dispensing apparatus includes automated dispense equipment, not shown, of a type generally disclosed in U.S. patent application Ser. No. 978,924, filed Nov. 19, 1992, the disclosure of which is herein incorporated by reference as if fully set forth herein. Canisters containing liquid or pulverulent material to be dispensed are located within side wing portions 12, 14 of the cabinet construction. Pumps and valves located in the wing portions 12, 14 and in the central cabinet portion 16 convey metered material to be dispensed through a head located in an overhanging cabinet portion or hood 20 disposed above a roller shelf, generally indicated at 24. The roller shelf includes a base or housing 26 attached to the front of cabinet portions 12–16.

Figure 9:
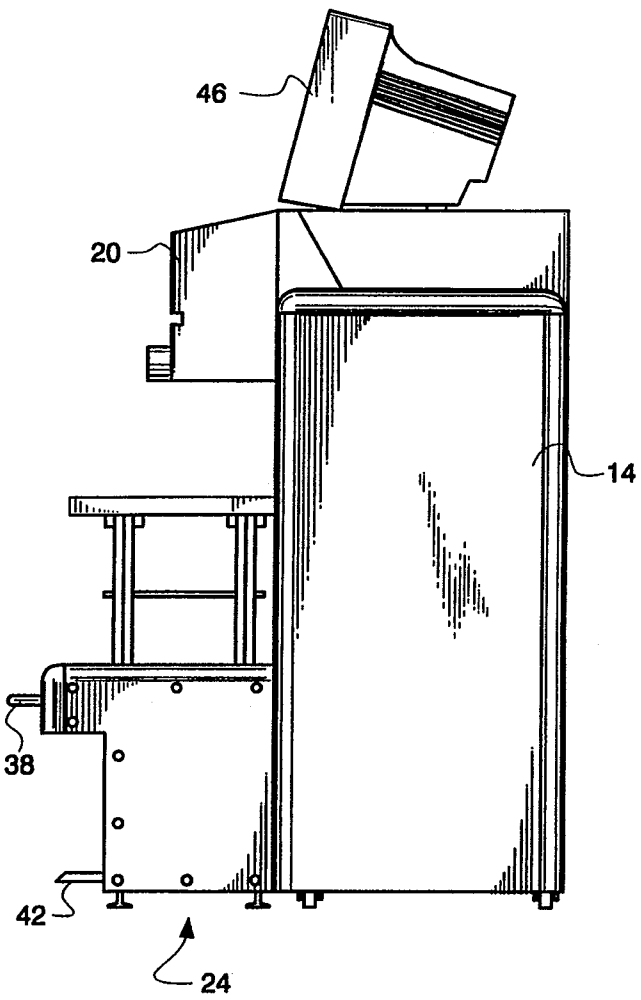
FIG. 9 is an elevational view taken from the right side thereof.

The roller shelf 24 includes end portions 30, 32 and a center portion 36. A handle 38 is attached to the center portion 36 to lift the center portion above the end portions 30, 32, in the manner indicated in FIGS. 8 and 9, for example. A foot pedal 42 releases the center shelf portion 36 for raising and lowering, the shelf portion being selectively locked at a plurality of intermediate portions, in a manner to be described herein.

Dispensing is preferably carried out in a fully automated fashion, under control of a microcomputer, analog circuit, or other control device. A CRT monitor 46 displays to an operator output data associated with the dispensing operation.

Containers to receive the dispensed material are placed either directly on the center shelf portion 36, or more usually on the end shelf portions 30, 32, and are thereafter rolled onto the center shelf portion 36. The center shelf portion is then raised to bring the upper end of the container into closer proximity to the dispense head located within the hood 20. In the preferred embodiment, a photoelectric sensor 48 detects a container located at the correct height for a dispensing operation and is coupled to the control circuitry to provide an indication that a container is present on the dispensing apparatus, and that the control steps to complete a dispensing operation can be carried out.

Figure 8:
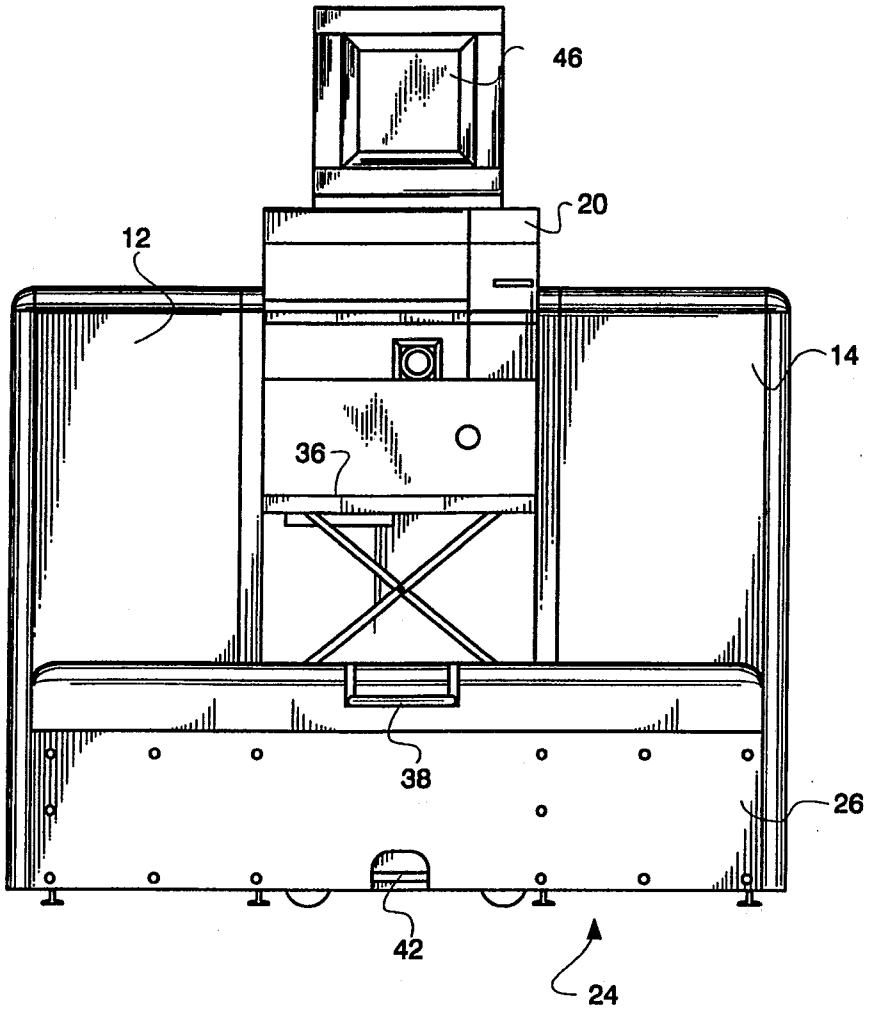
FIG. 8 is a front elevational view similar to that of FIG. 4, but showing the central shelf portion in a raised position.
Figure 11:
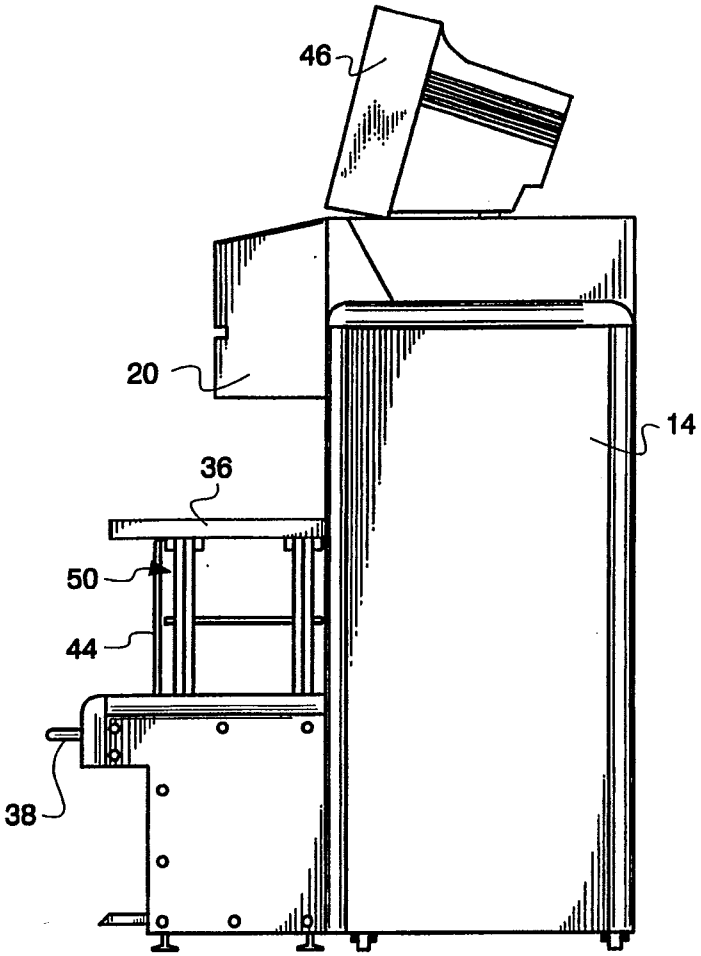
FIG. 11 is a side elevational view taken from the right side thereof.
Figure 10:
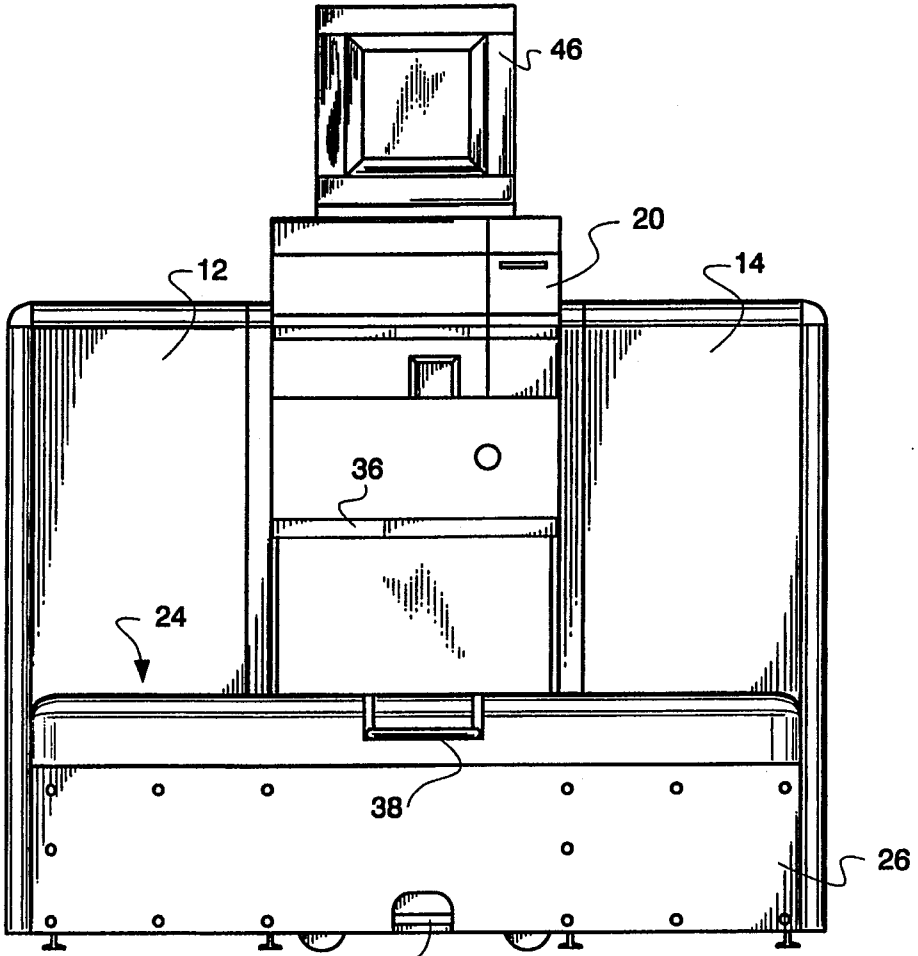
FIG. 10 is a front elevational view thereof similar to that of FIG. 8, but having a skirt concealing the scissors lift mechanism.
Figure 14:
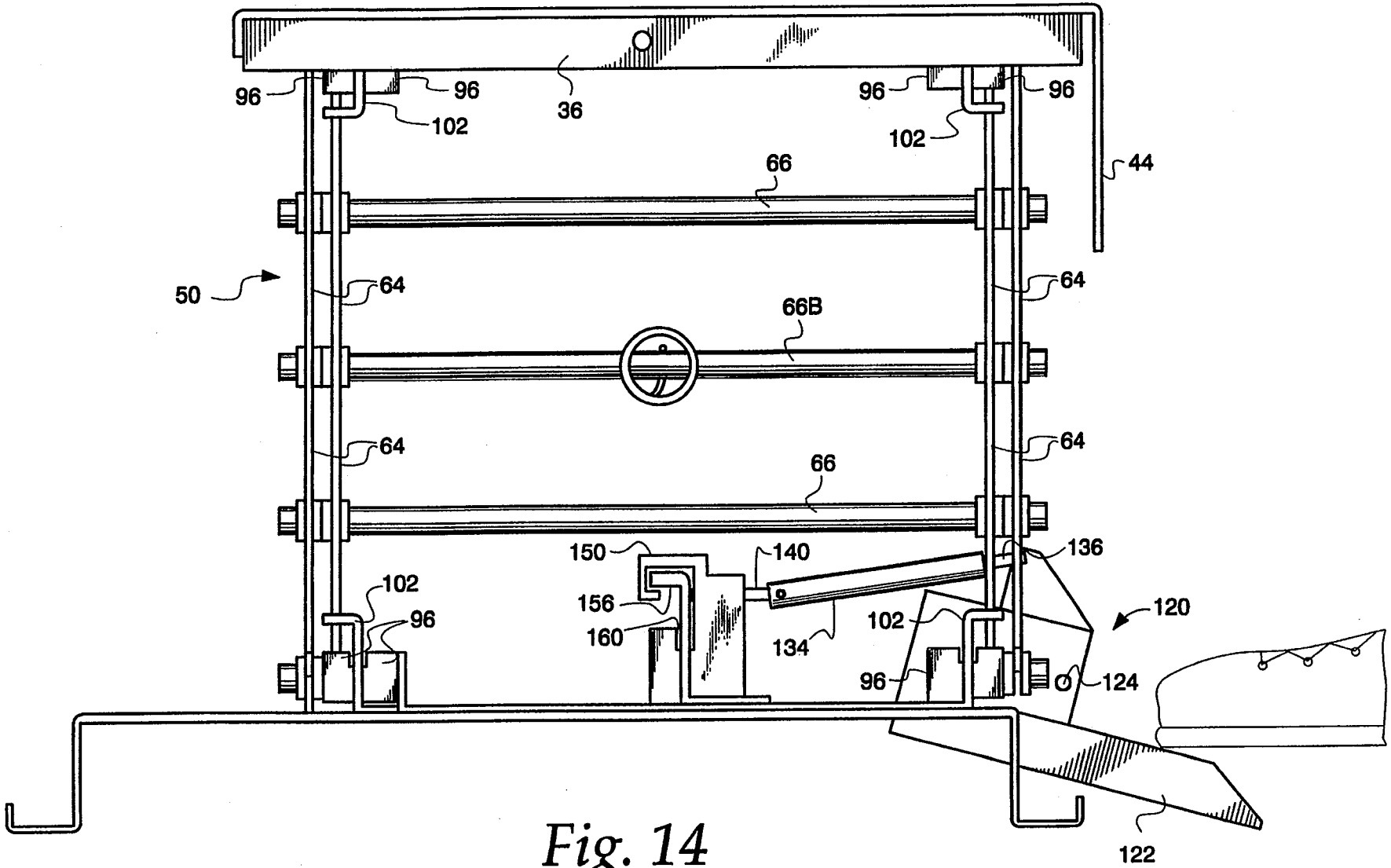
FIG. 14 is a view similar to that of FIG. 13, showing the mechanism in a different stage of operation.

FIG. 8 shows the center shelf portion 36 in a fully raised position, and the scissors lift mechanism, generally indicated at 50, can be seen. In FIGS. 10 and 11, a skirt is employed to cover the scissors lift mechanism, preventing unintentional contact therewith when the center shelf portion is raised and lowered. As can be seen in FIG. 14, for example, the skirt 44 depends from the central shelf portion 46 and overlies the upper end of the scissors lift mechanism 50.

Figure 12:
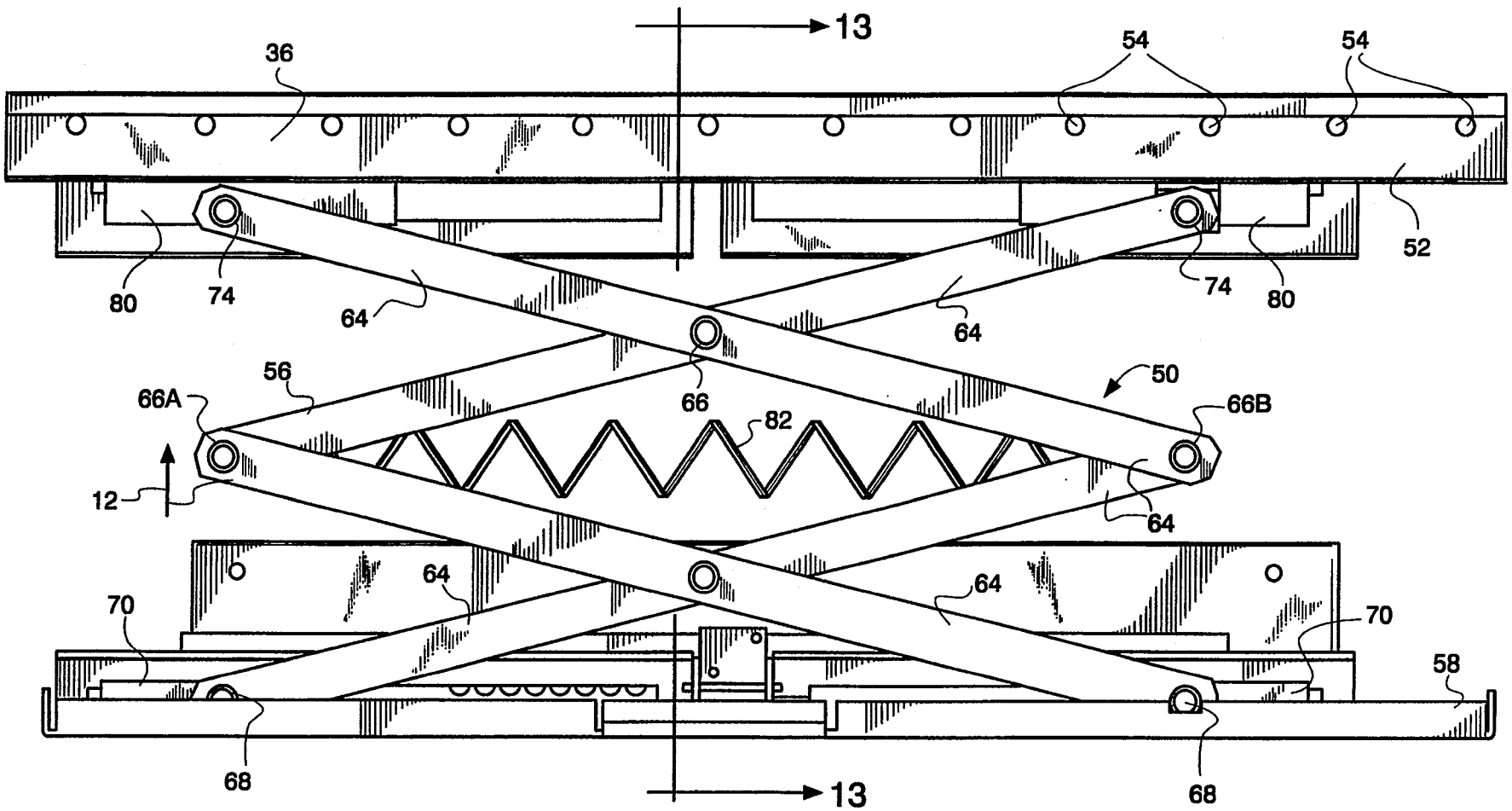
FIG. 12 is a front elevational view of the scissors lift mechanism.
Figure 13:
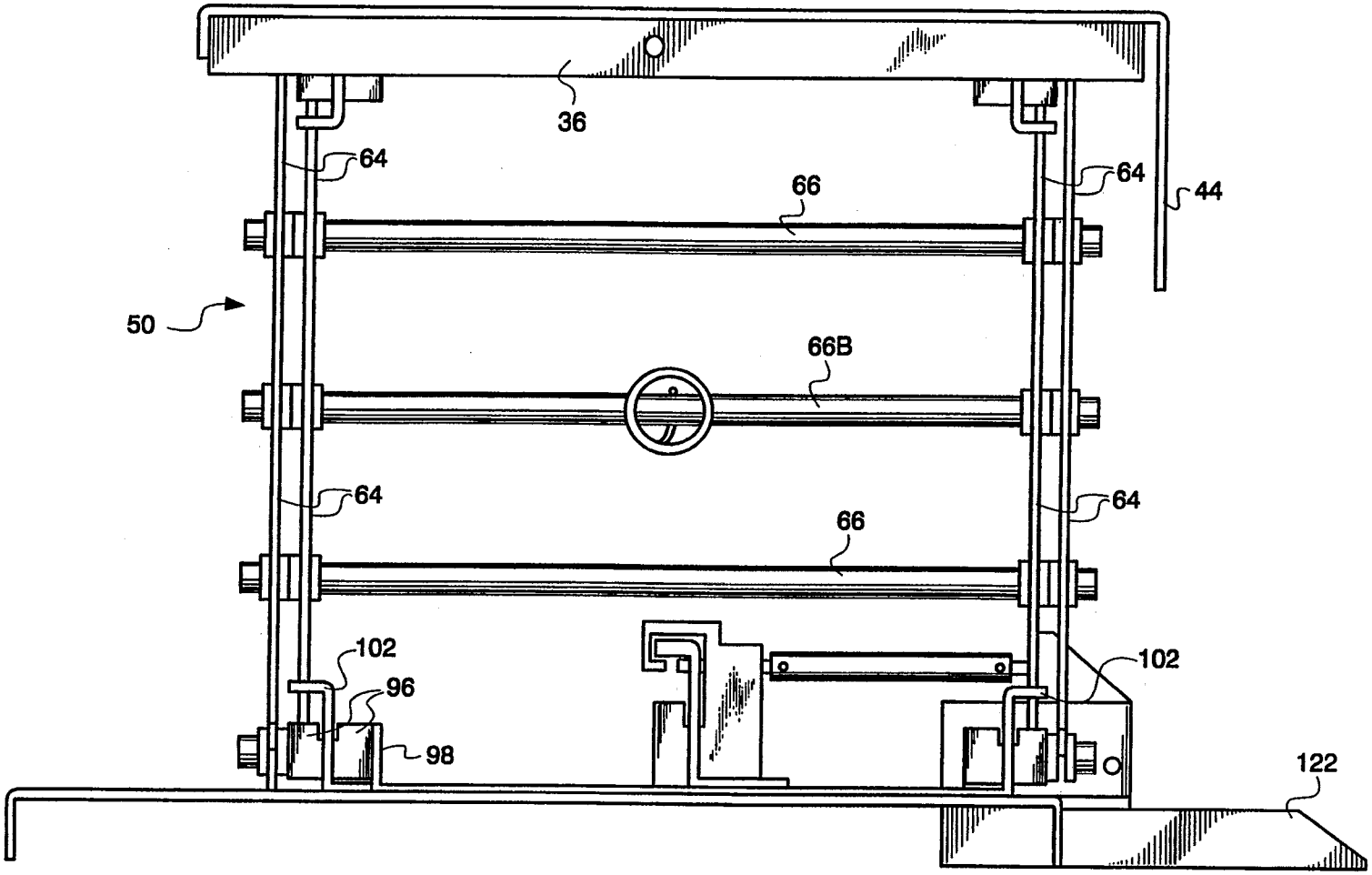
FIG. 13 is a fragmentary cross-sectional view taken along the line 13—13 of FIG. 12.

FIG. 12 shows the center shelf portion 36 and the scissors lift mechanism 50 in greater detail. The center shelf portion includes a front wall 52 to which a plurality of roller pins 54 are secured to mount the individual rollers 55, visible in FIG. 1. The scissors lift mechanism 50 includes scissors linkage 56 and a mounting base 58 in which a plurality of slide assemblies are located, as will be described shortly.

Figure 18:
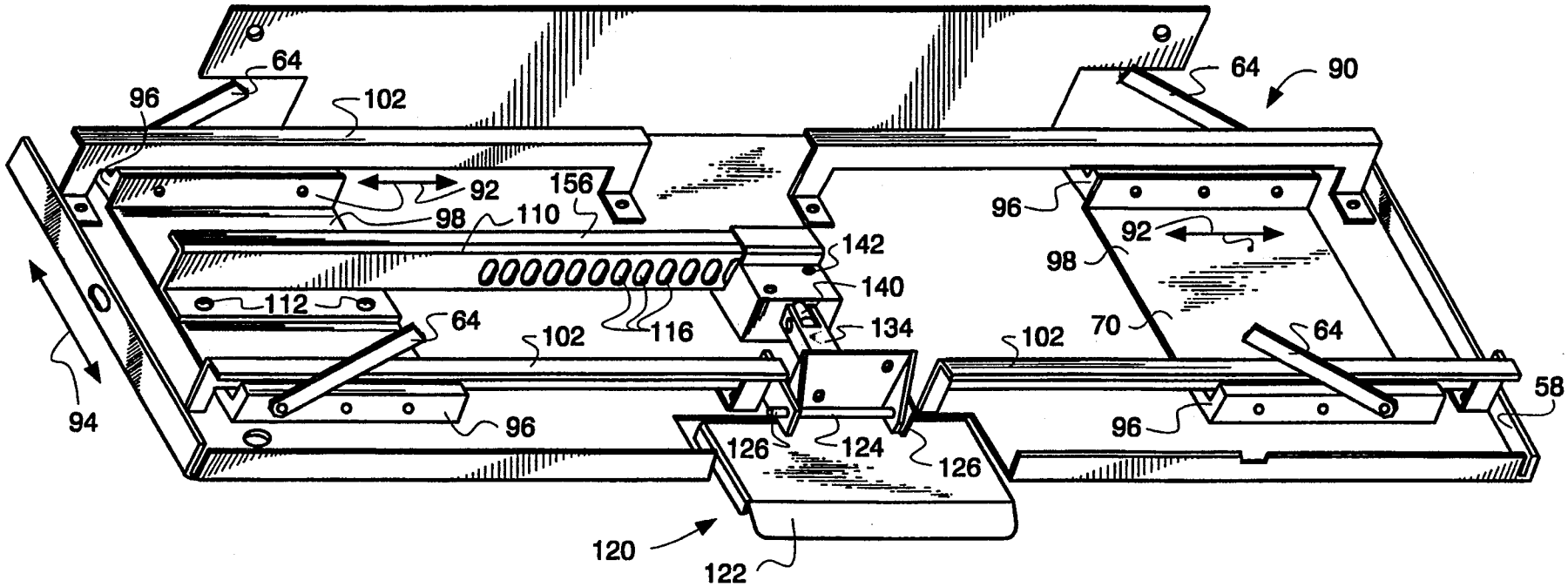
FIG. 18 is a perspective view similar to that of FIG. 15, but showing slide supports for both sides of the scissors mechanism.

The scissors linkage 56 includes link members 64 pinned together at 66. The lower end of the scissors linkage is pinned at 68 for pivotal attachment to a slide mounting or slide plate 70 (see FIG. 15). As can be seen in FIG. 18, two substantially identical slide plates 70 are used, one for each side of the scissors linkage lower end. Referring again to FIG. 12, a similar arrangement is used at the upper end of the scissors linkage, with the upper ends of link members 64 being pinned at 74 for pivotal attachment to slide mounts or slide plates 80. In the preferred embodiment, the slide plates 79, 80 are identical to each other and to the slide plates at the bottom of apparatus 10, except for the concession of a locking arrangement.

As shown in FIG. 12, a bias spring 82 is attached between pin members **66*a*, 66*b* so as to bias the scissors linkage 66 for upper movement, in the direction of arrow 84 in FIG. 12. In the preferred embodiment, the force of spring 82** is selected to counterbalance a container of preselected weight, typically an average weight for a range of containers expected to be accommodated by the present invention.

Figure 15:
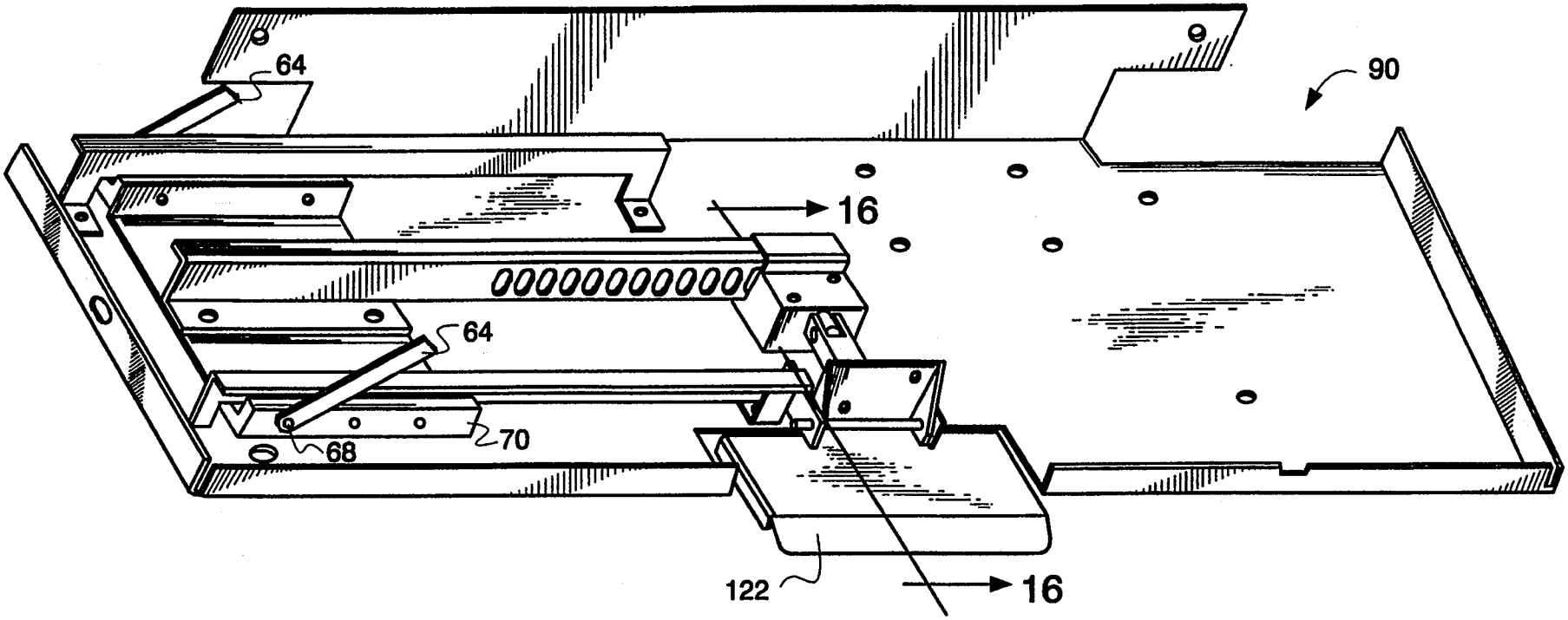
FIG. 15 is a partial perspective view of the scissors lift mechanism.

Referring now to FIGS. 15 and 18, a base assembly is generally indicated at 90. FIG. 15 shows part of the components of the base assembly removed, for purposes of clarity of the illustration. FIG. 18 shows both slide plates 70 mounted on mounting base 58 for reciprocation in the direction of arrows 92, that is, generally parallel to the major plane of the base plate 58. The slide plates 70 are constrained against front-to-back movement (i.e., movement in the direction of arrow 94 in FIG. 18) by upstanding ridges 96. The slide plate 70 is preferably constructed of multiple parts, with elongated channel members (preferably of low friction, nonmetallic material) comprising the upstanding ridges 96 and intermediate pan members 98 preferably formed of sheet metal stock. This preferred construction provides advantages over other constructions having a monolithic slide plate of uniform material composition, which would be dictated by the low friction requirements of the channels, and especially the ridges 96 thereof. In the preferred embodiment, the slide plate 70 is formed of channel members with ridges 96, made of low-friction material such as TEFLON or DELRIN, while the intermediate pan member 98 is formed of metal material.

The base assembly 90 further includes guide rails 102 secured to the mounting base 58 by rivets, screw fasteners or other suitable fastening means. As can be seen in FIG. 18, central portions of the guide rails 102 are elevated above the mounting base 58 and have bottom free edges received in the channel members, in channels formed between the upstanding ridges 96. Referring again to FIG. 18, a locking rail 110 is secured to pan member 98 with screw fasteners 112. The locking rail 110 includes a series of apertures 116 extending generally along the path of travel of the slide plates 70.

Figure 16:
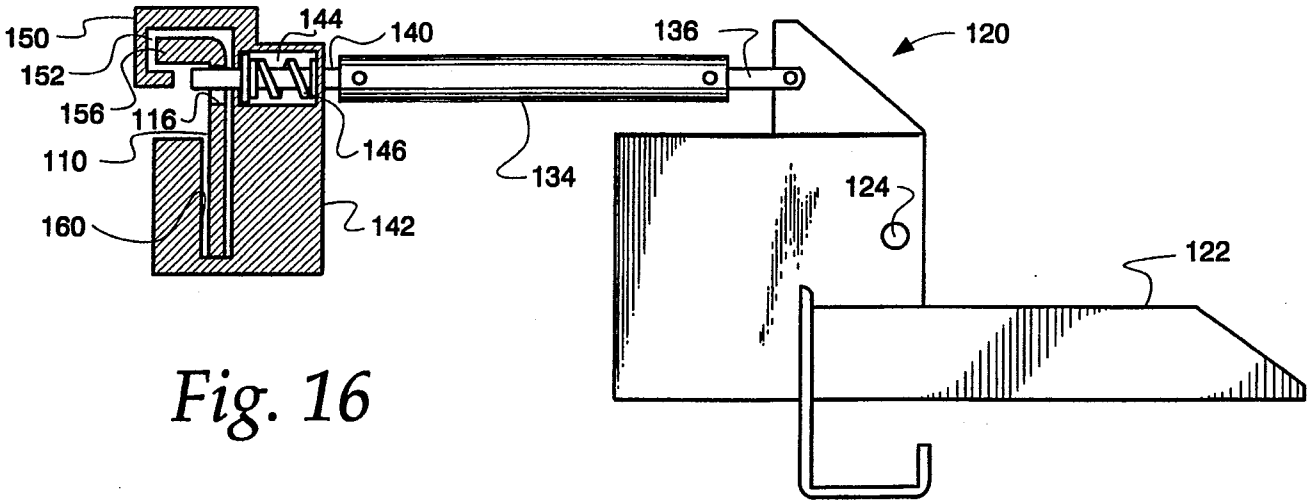
FIG. 16 is a fragmentary cross-sectional view taken along the line 16—16 of FIG. 15.

A lock mechanism is generally indicated at 120, and includes a foot pedal 122 pivotally mounted by shaft 124 to legs 126 of mounting base 58. As shown in FIG. 16, the foot pedal 122 is in a normal or a locked position and is depressed in the direction of arrow 130 to assume the unlocked position shown in FIG. 17. A double-ended clevis link 134 is coupled through a pin 136 at one end to foot pedal 122 and is coupled at the other end to a locking pin 140.

The locking pin 140 is inserted through a mounting block 142 and passes through an internal chamber 144 formed in mounting block 142 so as to receive a bias spring 146, which biases the lock mechanism 120 to the normal, rest or locked, position, shown in FIG. 16.

Figure 17:
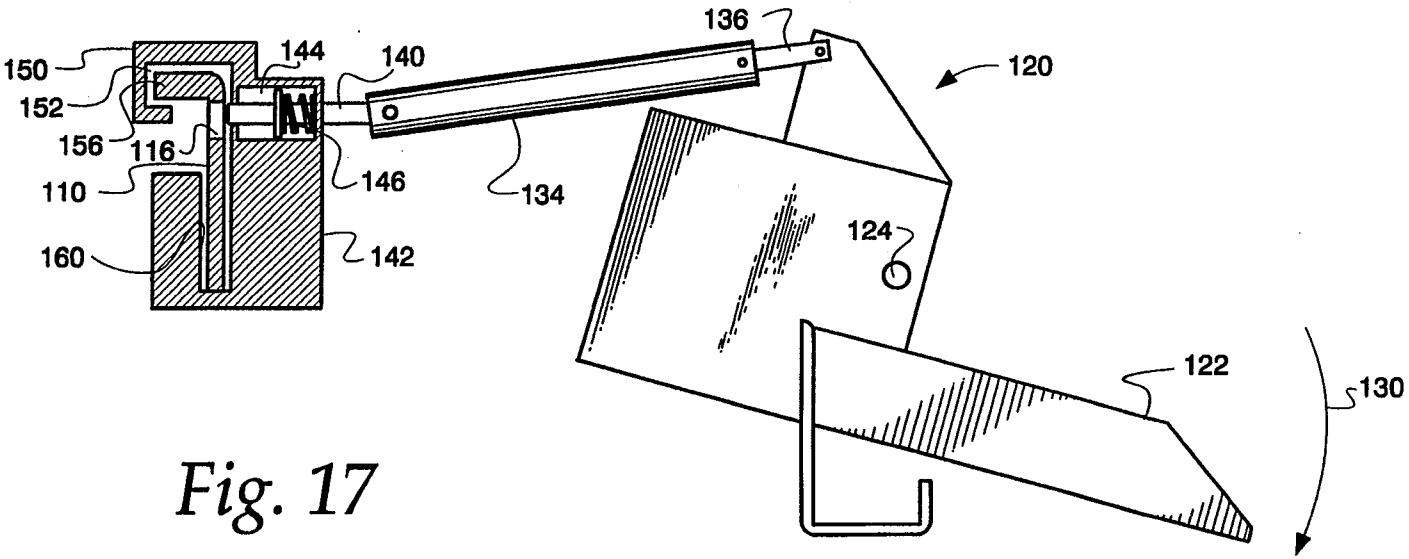
FIG. 17 is a view similar to that of FIG. 16, but showing a different stage of operation.

Referring to FIGS. 16 and 17, mounting block 142 includes an upper portion 150 defining an internal channel 152 for receiving the upper L-shaped end 156 of locking rail 110. The lower end of mounting block 142 defines a channel 160 which receives the lower end of the locking bar. As will now be appreciated, the locking bar 110 slides through the mounting block 142 as the left-hand slide plate of FIG. 18 reciprocates in the direction of arrow 92.

As shown in FIG. 16, when the foot pedal 122 is in a raised position, bias spring 146 urges the free end of locking pin 140 through an aperture 116 of locking bar 110, thus fixing the left-hand slide plate 70 in a fixed position. This in turn fixes the height of the center shelf portion 36 carried on the scissors lift mechanism 50. When the foot pedal 122 is depressed, as shown in FIG. 17, the free end of locking pin 140 is retracted from the aperture 116 and locking rail 110 is free to reciprocate, along with slide plate 70, in the direction of arrow 92 of FIG. 18, thus allowing the scissors lift mechanism 50 to be adjusted in height. As will now be appreciated, both of the operator's hands are free to manipulate the upper end of the scissors lift mechanism.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is

1. Apparatus for dispensing material into a container, comprising:

a supporting frame;

a housing supported by said frame;

dispense means supported by said housing for controlling a flow of material therethrough in response to control commands;

container support means supported by said frame for supporting the container below said dispense means, said container support means including a pair of end portions with an intermediate portion therebetween;

mounting means for movably mounting the intermediate portion for movement toward and away from said dispense means, said mounting means including a plurality of linkages pivotally connected to form a scissors support having an end and which is extendible toward the dispense means and collapsible away from the dispense means so as to cooperate with said end portions to form a generally continuous support surface across which a container can be moved, said mounting means including a base with a pair of slide plates engaging the base so as to be slidable therealong, said slide plates attached to the end of said scissors support; and locking means including a lock bar attached to one said slide plate and defining a plurality of apertures, and a lock pin supported by said base so as to be selectably movable toward and away from said lock bar, into and out of engagement with said lock bar so as to lock and unlock said one slide plate.

2. The apparatus of claim 1 wherein said locking means includes a mounting block defining a pin-receiving passageway through which said lock pin passes.

3. The apparatus of claim 2 wherein said locking means further includes a foot pedal movable between first and second positions, and means for coupling the foot pedal to the lock pin so as to move the lock pin toward and away from said lock bar as the foot pedal is moved between first and second positions.

4. The apparatus of claim 2 wherein said lock bar has a generally L-shaped cross section and said mounting block includes a bar-receiving portion defining another passageway of generally L-shaped cross section through which said lock bar passes.

5. The apparatus of claim 4 wherein said bar-receiving portion extends at generally a right angle to said pin-receiving passageway.

6. The apparatus of claim 1 further comprising a second pair of slide plates engaging the intermediate portion so as to slide therealong as the scissors support is extended toward and away from the dispense means.

* * * * *